US009642239B2

(12) United States Patent
Kephart

(10) Patent No.: US 9,642,239 B2
(45) Date of Patent: May 2, 2017

(54) CONDUCTION COOLING SYSTEMS FOR LINEAR ACCELERATOR CAVITIES

(71) Applicant: Robert Kephart, Batavia, IL (US)

(72) Inventor: Robert Kephart, Batavia, IL (US)

(73) Assignee: Fermi Research Alliance, LLC, Batavia (IL)

( * ) Notice: Subject to any disclaimer, the term of this patent is extended or adjusted under 35 U.S.C. 154(b) by 173 days.

(21) Appl. No.: 14/689,695

(22) Filed: Apr. 17, 2015

(65) Prior Publication Data

US 2016/0309573 A1 Oct. 20, 2016

(51) Int. Cl.
*H05H 7/22* (2006.01)
*H05H 7/20* (2006.01)

(52) U.S. Cl.
CPC ..... *H05H 7/22* (2013.01); *H05H 7/20* (2013.01)

(58) Field of Classification Search
CPC .. H05H 7/22; H05H 7/20; H05H 9/00; H05H 9/04; H05H 7/18; H05H 1/28
See application file for complete search history.

(56) References Cited

U.S. PATENT DOCUMENTS

| | | | |
|---|---|---|---|
| 5,497,050 | A | 3/1996 | Cheo |
| 5,504,341 | A | 4/1996 | Glavish |
| 6,025,681 | A | 2/2000 | Yu et al. |
| 6,281,622 | B1 | 8/2001 | Valentian et al. |
| 6,348,757 | B1 | 2/2002 | Marini |
| 7,239,095 | B2 | 7/2007 | Ho |
| 8,593,146 | B2 | 11/2013 | Gao et al. |
| 2013/0328506 | A1 | 12/2013 | Yamamoto et al. |

*Primary Examiner* — Tracie Y Green
(74) *Attorney, Agent, or Firm* — Luis M. Ortiz; Kermit D. Lopez; Ortiz & Lopez, PLLC

(57) ABSTRACT

A conduction cooling system for linear accelerator cavities. The system conducts heat from the cavities to a refrigeration unit using at least one cavity cooler interconnected with a cooling connector. The cavity cooler and cooling connector are both made from solid material having a very high thermal conductivity of approximately $1\times10^4$ W $m^{-1}$ $K^{-1}$ at temperatures of approximately 4 degrees K. This allows for very simple and effective conduction of waste heat from the linear accelerator cavities to the cavity cooler, along the cooling connector, and thence to the refrigeration unit.

20 Claims, 5 Drawing Sheets

CONDUCTION COOLING SYSTEMS FOR LINEAR ACCELERATOR CAVITIES

STATEMENT REGARDING FEDERALLY SPONSORED RESEARCH OR DEVELOPMENT

The invention described herein was made by an employee of the United States Government and may be manufactured and used by the Government of the United States of America for governmental purposes without the payment of any royalties thereon or therefore.

BACKGROUND OF THE INVENTION

1. Field of Invention

This invention relates to the field of electric lamp and discharge devices and more specifically to linear accelerators (linacs).

2. Description of Related Art

Linear accelerator devices use intense radio frequency electromagnetic fields to accelerate the speed of particles to create beams used for a variety of applications. These applications include driving industrial processes, security & imaging applications, food and medical sterilization, medical treatments, isotope creation and physics research. Superconducting radio frequency (SRF) technology allows the construction of linear accelerators that are both compact and efficient at using "wall plug" electrical power to create a particle beam. The cavity of an SRF linear accelerator must operate at an extremely low temperature. Excitation with the radio frequency power required for particle acceleration requires constant removal of waste heat generated in the SRF cavity.

Currently, cooling SRF cavities uses large quantities of cryogens such as liquid helium. These cryogens are pressurized fluids having an extremely low temperature. To provide the needed cryogens, the cryogenic systems themselves require complex integration of expansion engines or turbines, heat exchangers, cryogen storage units, gaseous inventory systems, compressors, piping, purification systems, control systems, and safety relief and venting systems. These systems require substantial space, energy, labor and money for operation and maintenance. Use of cryogens also requires cavity tuners to compensate for radio frequency resonance changes in SRF cavities due to pressure changes. Presently these issues limit the utility of SRF linear accelerators.

There is an unmet need for more efficient and less complex cooling systems for SRF based linear accelerators.

BRIEF SUMMARY OF THE INVENTION

A conduction cooling system for at least one linear accelerator cavity includes at least one cavity cooler operatively interconnecting the at least one linear accelerator cavity and a cooling connector, and a refrigeration source operatively connected to the cooling connector. The at least one cavity cooler and the cooling connector are made from a material having a thermal conductivity no lower than approximately $1\times10^4$ W $m^{-1}$ $K^{-1}$ at temperatures of approximately 4 degrees K.

BRIEF DESCRIPTION OF SEVERAL VIEWS OF THE DRAWING(S)

TERMS OF ART

As used herein, the term "quality factor" is the ratio of the stored energy of the linear accelerator cavity to the energy lost as heat into the cavity walls per radio frequency oscillation cycle.

DETAILED DESCRIPTION OF THE INVENTION

Figure 1:
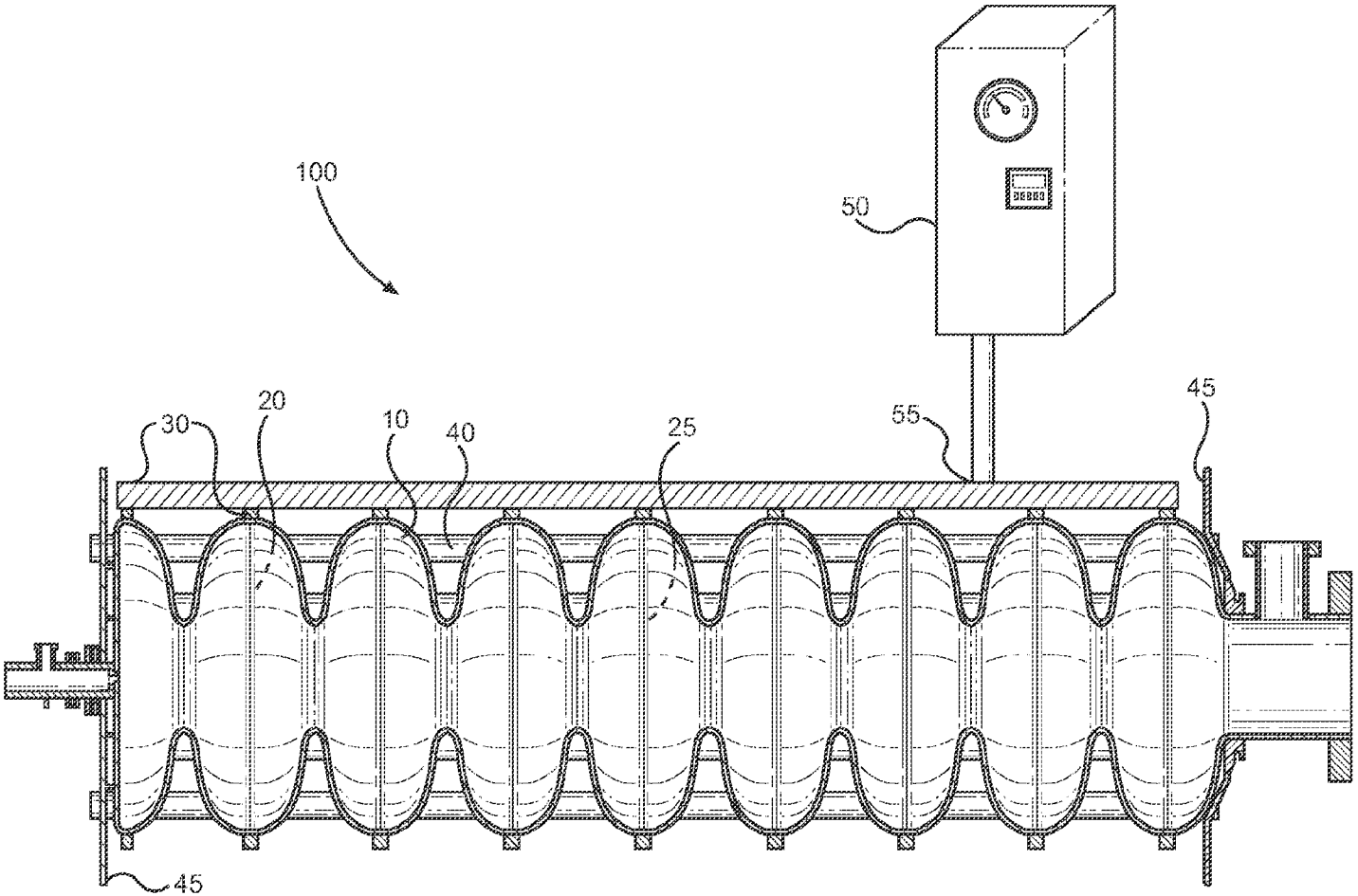
FIG. 1 illustrates an exemplary embodiment of a system for conduction cooling linear accelerator cavities.

FIG. 1 illustrates an exemplary embodiment of a system 100 for conduction cooling linear accelerator cavities. System 100 includes at least one linear accelerator cavity 10, at least one cavity cooler 20, a cooling connector 30, an optional mechanical support system 40 and a refrigeration source 50. The average cross-section A of cavity cooler 20 and cooling connector 30 is determined using the equation $$A = \frac{Q * L}{\Delta T * C}$$

wherein Q is an average heat load of linear accelerator cavity 10, L is an average distance between linear accelerator cavity 10 and refrigeration source 50, ΔT is a maximum allowable temperature rise from linear accelerator cavity 10 to refrigeration source 50 and C is a thermal conductivity of cavity cooler 20 and cooling connector 30.

In the exemplary embodiment, linear accelerator cavity 10 is an SRF cavity with a minimum quality factor of approximately $1*10^8$. Linear accelerator cavity 10 comprises a metallic or ceramic material that is superconducting at a cavity operating temperature. This material may constitute the entire cavity or be a coating on an inner surface of linear accelerator cavity 10. In the exemplary embodiment, linear accelerator cavity 10 comprises pure niobium. In other embodiments, linear accelerator cavity 10 may be, but is not limited to, a niobium, aluminum or copper cavity coated in niobium-tin ($Nb_3Sn$) or other superconducting materials.

In the exemplary embodiment, cavity cooler 20 at least partially encircles linear accelerator cavity 10, making thermal contact to remove heat from linear accelerator cavity 10. Materials used for cavity cooler 20 must have a minimum thermal conductivity of approximately $1\times10^4$ W $m^{-1}$ $K^{-1}$ at temperatures of approximately 4 degrees K. Such materials with high thermal conductivity include, but are not limited to, high-purity aluminum, diamond or carbon nanotubes. In certain embodiments, cavity cooler 20 includes multiple cavity coolers 20.

Cavity cooler 20 may also include an intermediate conduction layer 25 between cavity cooler 20 and linear accelerator cavity 10 to improve thermal conductivity. Intermediate conduction layer 25 is a ductile material, such as, but not limited to, indium or lead. The thermal conductivity of intermediate conduction layer 25 results in a thermal resistance between linear accelerator cavity 10 and cavity cooler 20 of no more than approximately 10% of the thermal conductivity of cavity cooler 20.

In the exemplary embodiment, cooling connector 30 connects each cavity cooler 20 to refrigeration source 50. Materials used for cooling connector 30 must have a minimum thermal conductivity of approximately $1\times10^4$ W $m^{-1}$ $K^{-1}$ at temperatures of approximately 4 K. Such materials with high thermal conductivity, include, but are not limited to, high-purity aluminum, diamond or carbon nanotubes. In certain embodiments, multiple cooling connectors 30 connect cavity cooler 20 to refrigeration source 50. In certain embodiments, cooling connectors 30 are flexible.

Optional mechanical support system 40 stabilizes linear accelerator cavity 10. In the exemplary embodiment, mechanical support system 40 is a plurality of support rods. In another embodiment, mechanical support system 40 is a solid cylinder. Mechanical support system 40 connects to linear accelerator cavity 10 via endplates 45. Mechanical support system 40 and endplates 45 are made of a material having an identical or substantially similar thermal expansion coefficient as linear accelerator cavity 10.

In the exemplary embodiment, refrigeration source 50 is a commercially available cryocooler having a power requirement of approximately 1 W to approximately 100 W. In another embodiment, refrigeration source 50 is a vessel containing cryogenic fluid. A cold tip 55 of refrigeration source 50 clamps to cooling connector 30. The clamping connection results in a thermal resistance between cooling connector 30 and cold tip 55 of no more than approximately 10% of the thermal resistance of cooling connector 30, allowing efficient conduction of heat from cooling connector 30 to refrigeration source 50.

Figure 2:
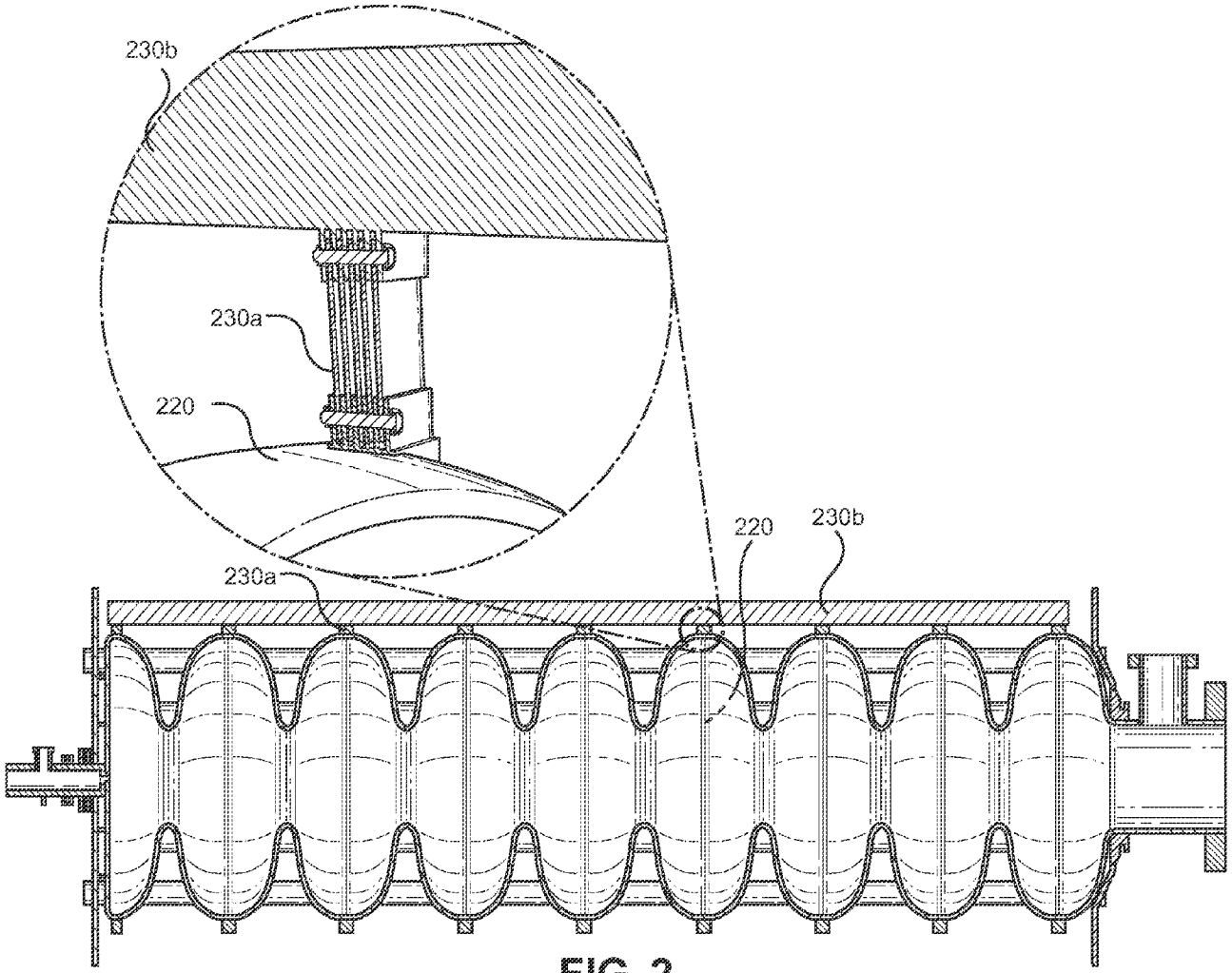
FIGS. 2-4 illustrate alternate embodiments of systems for conduction cooling linear accelerator cavities.

FIG. 2 illustrates an alternate embodiment of a system 200 for conduction cooling linear accelerator cavities 10. In system 200, cavity cooler 20 is a cooling ring 220 and cooling connector 30 is a plurality of cooling strips 230*a* connected to a cooling bar 230*b*. Cooling ring 220 may be applied to linear accelerator cavity 10 through direct casting, diffusion bonding, mechanical clamping or any other fabrication method resulting in a low thermal conductivity connection.

Figure 3:
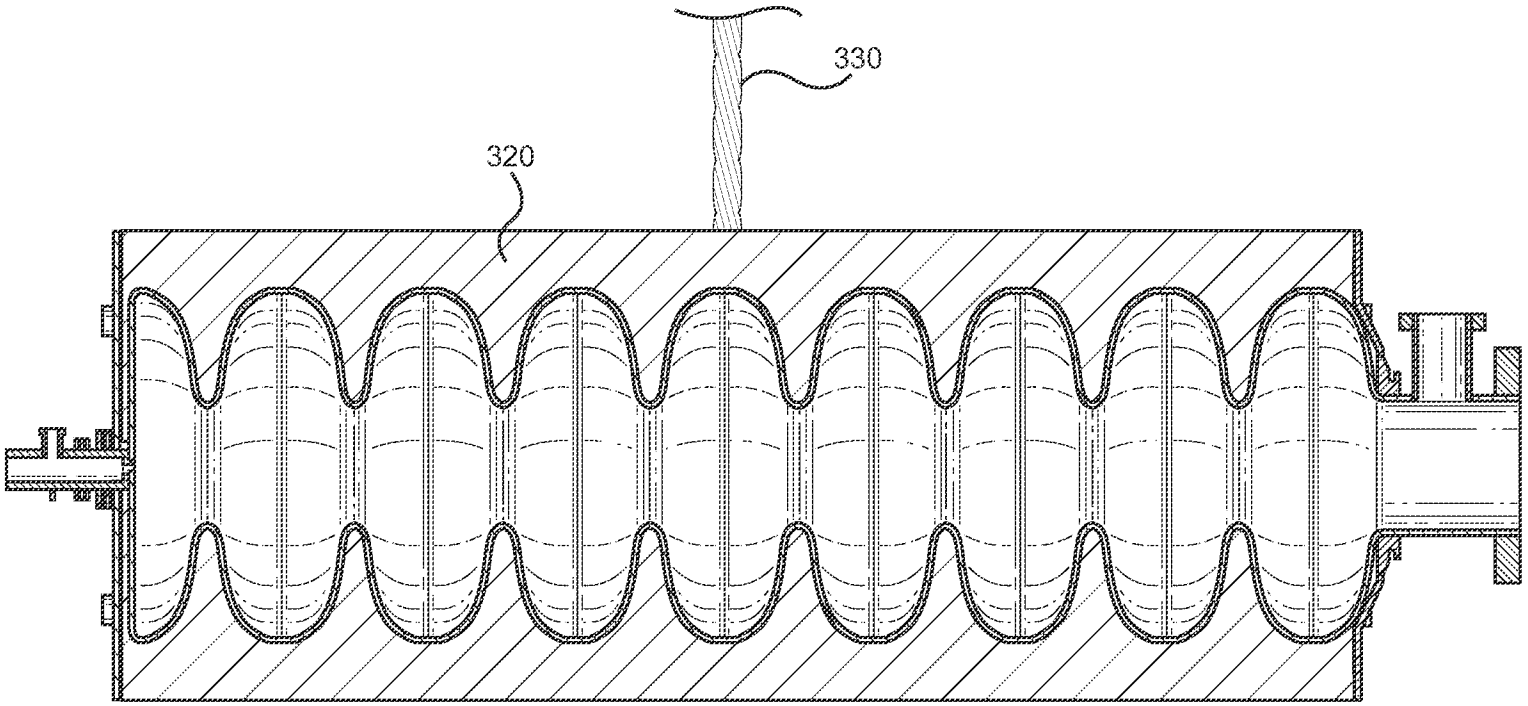

FIG. 3 illustrates an alternate embodiment of a system 300 for conduction cooling linear accelerator cavities 10. In the embodiment of system 300, cavity cooler 20 forms an integral cooling block 320 around multiple linear accelerator cavities 10 and cooling connector 30 is a flexible cooling braid 330. In this embodiment, mechanical support system 40 is unnecessary. Cooling block 320 may be applied to linear accelerator cavity 10 through direct casting, mechanical clamping or any other fabrication method resulting in a low thermal conductivity connection.

Figure 4:
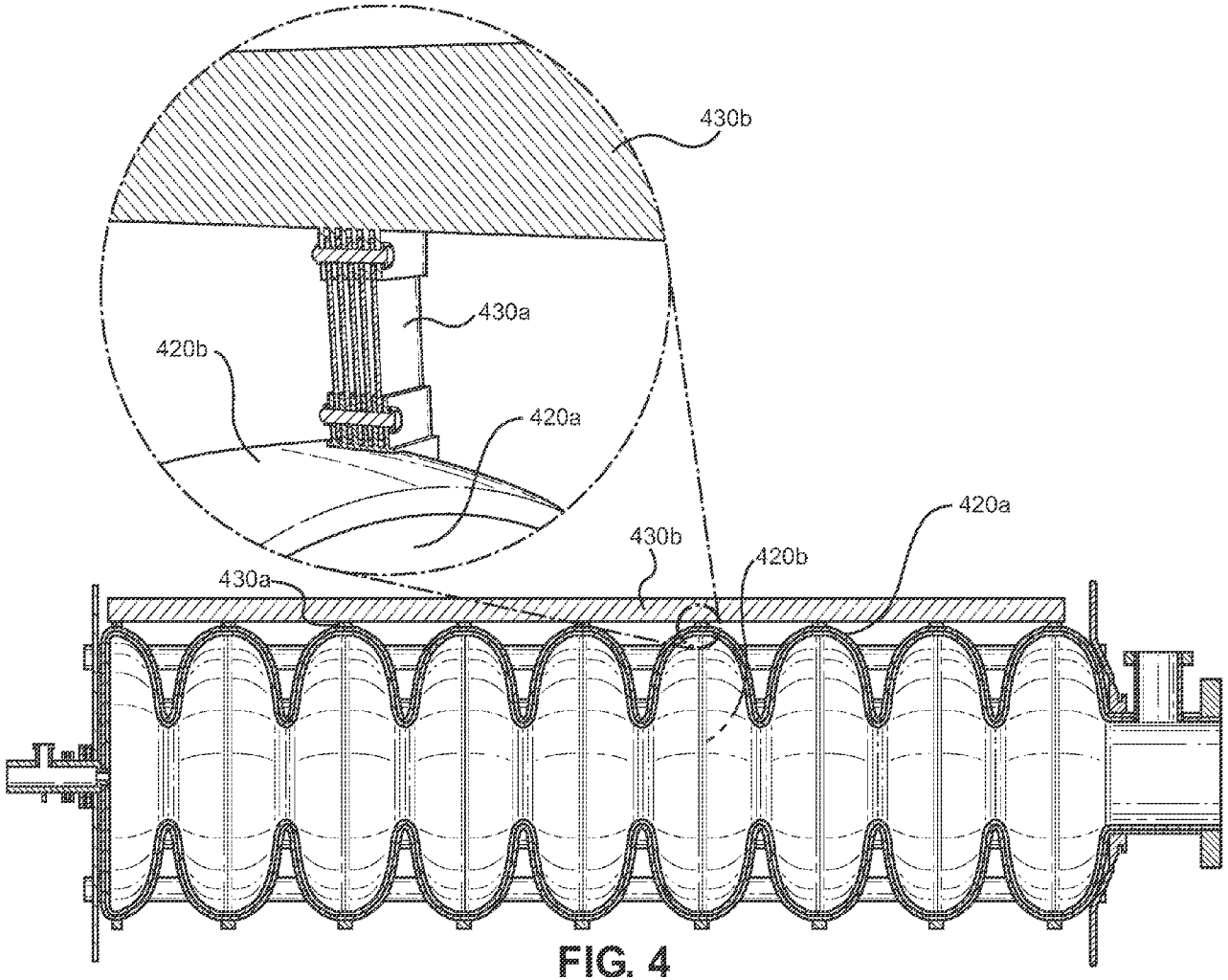

FIG. 4 illustrates an alternate embodiment of a system 400 for conduction cooling linear accelerator cavities 10. In the embodiment of system 400, cavity cooler 20 is a coating 420*a* and a cooling ring 420*b* around a portion of linear accelerator cavity 10, while cooling connector 30 is a plurality of cooling strips 430*a* connected to a cooling cylinder 430*b*. Coating 420 may be applied to linear accelerator cavity 10 through direct casting, diffusion bonding, mechanical clamping or any other fabrication method resulting in a low thermal conductivity connection.

Figure 5:
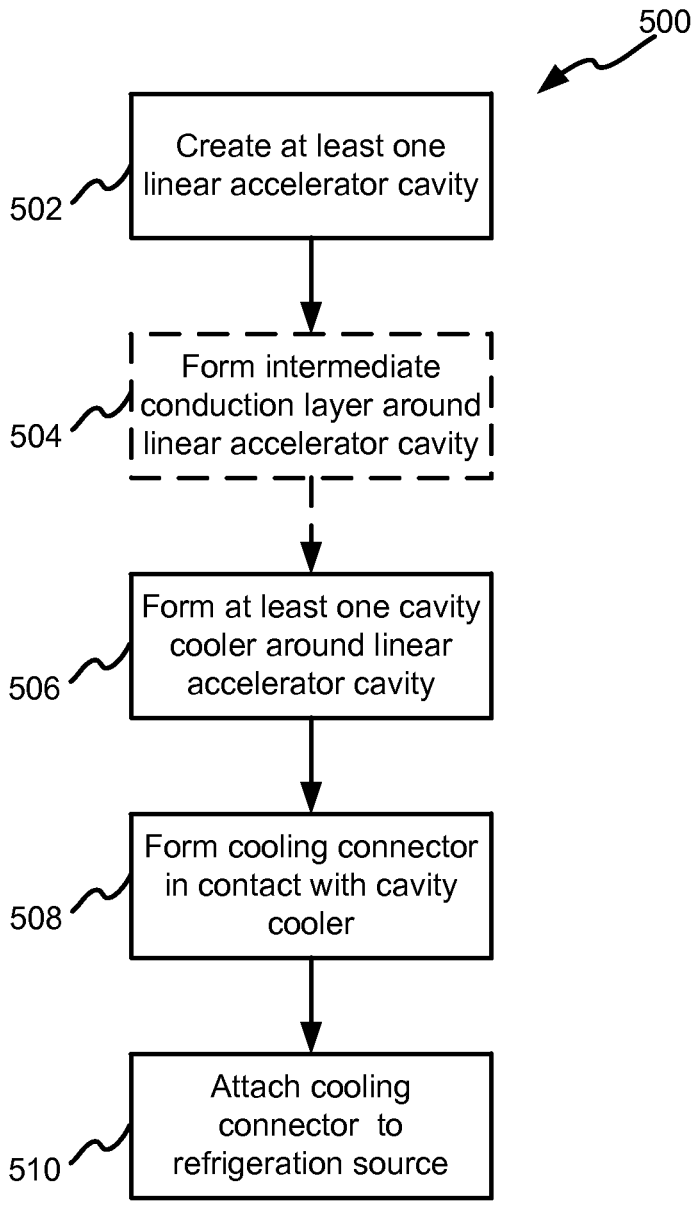
FIG. 5 illustrates a flowchart of an exemplary embodiment of a method of making a system for conduction cooling linear accelerator cavities.

FIG. 5 illustrates a flowchart of an exemplary embodiment of a method 500 of making a system 100 for conduction cooling linear accelerator cavities 10.

In step 502, method 500 creates at least one linear accelerator cavity 10.

In optional step 504, method 500 forms intermediate conduction layer 25 around at least part of linear accelerator cavity 10.

In step 506, method 500 forms at least one cavity cooler 20 around at least part of linear accelerator cavity 10. This formation may be through casting, fabrication, or deposition.

In step 508, method 500 forms at least one cooling connector 30 in contact with at least one cavity cooler 20. This formation may be through casting, fabrication, or deposition. In certain embodiments, method 500 may perform steps 506 and 508 simultaneously.

In step 510, method 500 attaches cooling connector 30 to refrigeration source 50. In one embodiment, cold tip 55 of refrigeration source 50 clamps to cooling connector 30.

It will be understood that many additional changes in the details, materials, procedures and arrangement of parts, which have been herein described and illustrated to explain the nature of the invention, may be made by those skilled in the art within the principle and scope of the invention as expressed in the appended claims.

It should be further understood that the drawings are not necessarily to scale; instead, emphasis has been placed upon illustrating the principles of the invention. Moreover, the terms "substantially" or "approximately" as used herein may be applied to modify any quantitative representation that could permissibly vary without resulting in a change in the basic function to which it is related.

What is claimed is:

1. A conduction cooling system for at least one linear accelerator cavity, said system comprising:

at least one cavity cooler operatively interconnecting said at least one linear accelerator cavity and a cooling connector, wherein said at least one cavity cooler and said cooling connector comprise a material having a thermal conductivity no lower than approximately $1\times10^4$ W $m^{-1}$ $K^{-1}$ at temperatures of approximately 4 degrees K; and a refrigeration source operatively connected to said cooling connector.

2. The system of claim 1, wherein said at least one linear accelerator cavity is an SRF cavity having a minimum quality factor of approximately $1*10^8$.

3. The system of claim 2, wherein said SRF cavity comprises metallic or ceramic material that is superconducting at a cavity operating temperature.

4. The system of claim 1, wherein an average cross-section A of said cavity cooler and said cooling connector is determined using the equation $$A = \frac{Q*L}{\Delta T*C}$$

wherein Q is a maximum heat load of said at least one linear accelerator cavity, L is an average distance between said at least one linear accelerator cavity and said refrigeration source, ΔT is a maximum allowable temperature rise from said at least one linear accelerator cavity and said refrigeration source and C is a thermal conductivity of said at least one cavity cooler and said cooling connector.

5. The system of claim 1, wherein said at least one cavity cooler and said cooling connector comprises a material selected from the group consisting of: high-purity aluminum, diamond, and carbon nanotubes.

6. The system of claim 1, wherein said at least one cavity cooler comprises a plurality of cavity coolers.

7. The system of claim 1, wherein said at least one cavity cooler is operatively connected to said linear accelerator cavity through a process selected from the group consisting of: direct casting, diffusion bonding, deposition, and mechanical clamping.

8. The system of claim 1, wherein said at least one cavity cooler is a cooling ring at least partially surrounding said linear accelerator cavity.

9. The system of claim 1, wherein said at least one cavity cooler is a cooling block at least partially surrounding said linear accelerator cavity.

10. The system of claim 1, wherein said at least one cavity cooler is a coating at least partially surrounding said linear accelerator cavity.

11. The system of claim 1, further comprising an intermediate conduction layer between said linear accelerator cavity and said at least one cavity cooler.

12. The system of claim 11, wherein said intermediate conduction layer is a ductile material having a thermal conductivity resulting in a thermal resistance between said linear accelerator cavity and said at least one cavity cooler of less than approximately 10% of said thermal resistance of said at least one cavity cooler.

13. The system of claim 11, wherein said intermediate conduction layer comprises a material selected from the group consisting of: indium and lead.

14. The system of claim 1, wherein said at least one cooling connecter comprises a plurality of cooling connecters.

15. The system of claim 1, wherein said at least one cooling connecter is selected from the group consisting of: a bar, a strip, and a cylinder.

16. The system of claim 1, wherein said at least one cooling connecter is flexible.

17. The system of claim 16, wherein said at least one cooling connecter is selected from the group consisting of: a braid and a rope.

18. The system of claim 1, wherein said refrigeration source further comprises a cold tip operatively coupled to said cooling connector such that a thermal resistance between said cooling connector and said cold tip is less than approximately 10% of said thermal resistance of said cooling connector.

19. The system of claim 1, wherein said refrigeration source is a cryocooler having a power rating of approximately 1 W to approximately 100 W.

20. The system of claim 1, wherein said refrigeration source is a vessel containing cryogenic fluid.

* * * * *